United States Patent [19]

Challet

[11] 4,324,542

[45] Apr. 13, 1982

[54] ELECTRONIC SAFETY DEVICE FOR A FLUID, PARTICULARLY GASEOUS, FUEL BURNER

[75] Inventor: Jacques Challet, Allegre, France

[73] Assignee: Constructions Electriques, Le Puy, France

[21] Appl. No.: 116,787

[22] Filed: Jan. 30, 1980

[30] Foreign Application Priority Data

Feb. 1, 1979 [FR] France ..... 79 02683

[51] Int. Cl.[3] ..... F23N 5/00

[52] U.S. Cl. ..... 431/78; 431/25; 431/71; 361/101; 361/154

[58] Field of Search ..... 431/25, 47, 58, 63, 431/71, 78, 46; 307/117; 361/100, 101, 134, 144, 154, 194; 251/129; 340/577

[56] References Cited

U.S. PATENT DOCUMENTS

| | | | |
|---|---|---|---|
| 3,291,183 | 12/1966 | Fairley | 431/78 |
| 3,396,314 | 8/1968 | Corson et al. | 361/154 |
| 3,577,040 | 5/1971 | Campbell, Jr. | 361/154 |
| 3,627,458 | 12/1971 | Wade | 431/78 |
| 3,649,156 | 3/1972 | Conner | 431/78 |
| 3,654,518 | 4/1972 | Phelps et al. | 361/101 |
| 3,906,309 | 9/1975 | Sullivan | 361/101 |
| 4,082,493 | 4/1978 | Dahlgren | 431/25 |
| 4,111,639 | 9/1978 | Matthews | 431/25 |

*Primary Examiner*—Samuel Scott
*Assistant Examiner*—Lee E. Barrett
*Attorney, Agent, or Firm*—Larson and Taylor

[57] ABSTRACT

An electronic safety device for a fluid, particularly gaseous fuel burner of the intermittent operating type.

The current supply to the electromagnetic valve controlling the input of gas to the burner is controlled by means of a switching transistor itself under the control of a bistable circuit. The inputs to this circuit receive signals translating the presence or the absence of certain operating conditions. The hysteresis properties of the electromagnetic valve are also used by means of an overvoltage circuit.

This device may be applied to all heating apparatus, particularly those whose power supply source has a reduced capacity.

6 Claims, 1 Drawing Figure

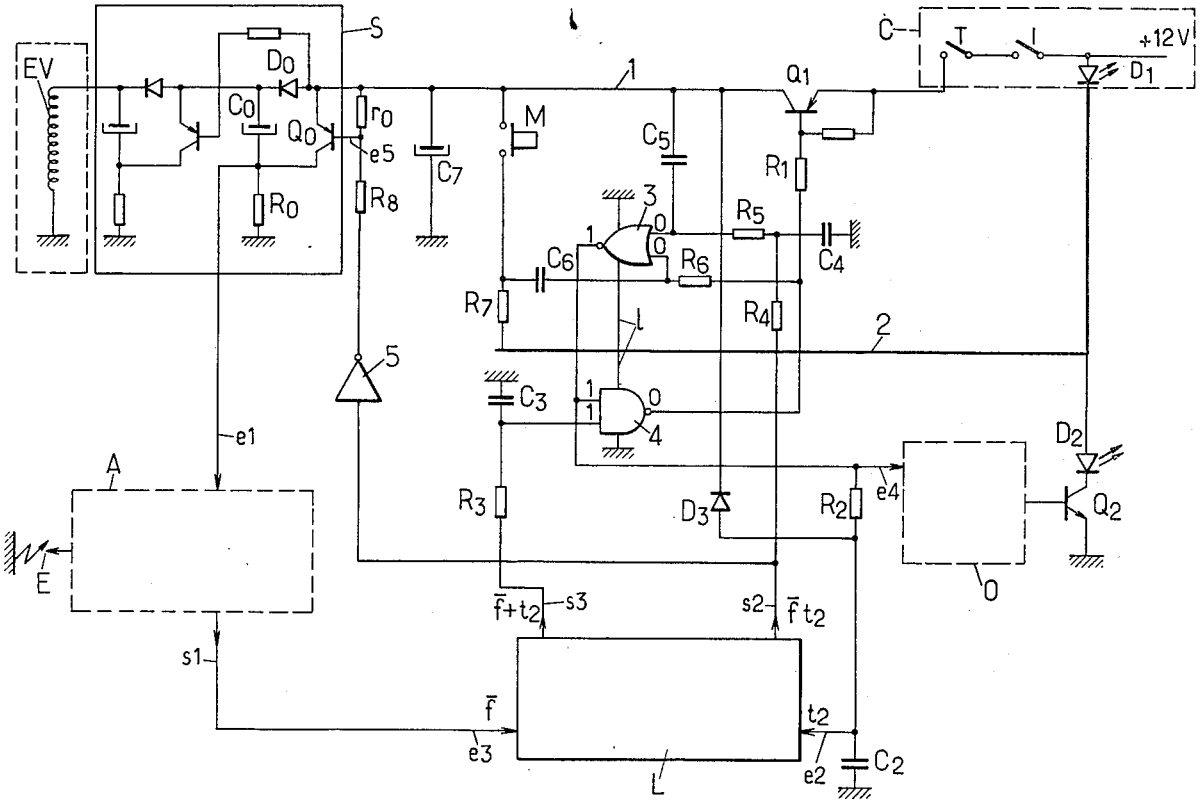
EV
S
D0
C0
Q0
r0
e5
R0
R8
C7
M
1
C5
Q1
R1
C
T
I
+12V
D1
3
R5
C4
C6
R6
R7
R4
l
2
5
C3
4
e1
A
E
R3
D3
R2
e4
D2
Q2
O
f̄+t2
s3
s2
f̄ t2
s1
f̄
t2
e3
e2
C2
L

ELECTRONIC SAFETY DEVICE FOR A FLUID, PARTICULARLY GASEOUS, FUEL BURNER

The present invention relates to an electronic safety device for a burner for a fluid, particularly gaseous, fuel of the intermittent operating type, this device being of the type adapted to operate in successive cycles for alternately producing a flame and producing its extinction, depending respectively on the presence or the absence of a demand for heat, the fuel supply to the burner being controlled by an electromagnetic valve connected to an electric power supply circuit comprising for this purpose one or more manually and/or automatically controlled switching members, this connection being made through a controlled switch member, which device is furthermore of a type having several operating states one at least of which is a so-called "safety" state in which the input of fuel to the burner is prohibited, this state being able to disappear only by manual actuation of a so-called "resetting" means.

Numerous devices of this type are already known which are often arranged at the same time to provide the function of igniting the burner. However, the essential function of these devices is to interrupt the input of fuel to the burner by means of the above-mentioned electromagnetic valve when an anomaly is detected in the operation of the burner or in that of the device itself, which brings this latter into the so-called "safety" state mentioned above. As for the so-called "resetting" means, it will be situated most often in the immediate vicinity of the burner, so as to force the user to be present during an igniting attempt following setting in the safety state, i.e. after a cut in the fuel supply.

In known devices, the member controlling the energizing of the electromagnetic valve, called above "controlled switch member" is very frequently an electromagnetic relay itself subjected to a non zero failure rate, whereby the electromagnetic valve may remain energized even though its control relay is no longer supplied: this constitutes of course a serious defect in so far as safety is concerned.

One of the aims of the invention is to eliminate this disadvantage, inherent in this precise case of application, in the use of electromagnetic relays.

Furthermore, it should be noted that though the cost of known safety devices, even sophisticated, is tolerable for high power installations, the cost of other devices even rudimentary, for monitoring small installations is still too high to permit their general use.

Another aim of the invention is then to provide an economical safety device, presenting risks of dangerous situations occurring comparable to, if not less, than those presented by known devices of a higher cost.

A further aim of the invention is to provide substantial saving in the electrical power consumed by the device, so that its use may be considered in cases where it has not been used up to now for this reason, e.g. in vehicles, boats or caravans, even in cases of dry cell power supply (independent heat sources, camping equipment because of the relatively short life of the electrical power supply sources in all these cases.

With these ends in mind, an electronic safety device of the type mentioned above is in accordance with the invention characterized in that said controlled switch member is of the semi-conductor type; in that a multi-input circuit having a bistable function is provided whose output is connected to the control electrode of said switch member; in that said circuit with bistable function is of a type such that said output may assume a first state called "normal operating state" following manual actuation of said resetting means, and a second state called "fault detection state" following the appearance of one or more conditions requiring for safety reasons interruption of the fuel supply at the latest at the time of a further heat demand cycle; and in that it comprises furthermore means for detecting a short circuit of said semi-conductor switch device, connected to one of the inputs of said circuit with bistable function so as to bring its output into said fault detection state if a short circuit of said member occurs.

It can be seen that the invention avoids the use—moreover costly—of an electromagnetic relay for controlling the operation of the electromagnetic valve, and thus eliminates the disadvantages inherent in this type of member, particularly in so far as the power consumption and reliability are concerned. The use of a transistor, thyristor etc.. or of any other controlled switch member of the semi-conductor type, in place of the relay, will also easily prevent, in combination with the use of said short-circuit detecting means, for the sake of security (placing in a safety state) the feeding of fuel to the burner, at the latest at the next heat demand cycle in the case where it is ascertained (placing in the fault detection state) that said member is no longer able to assume its normal function of controlling the electromagnetic valve.

It is in fact admitted in the present technique that a failure of a component of the device may be detected only at the time of an attempt to ignite subsequent to its appearance, and not immediately, since the probability of substantially simultaneous appearance, during the same operating cycle, of two failures together leading to a dangerous situation is extremely small. Such a risk is not appreciable compared with risks having other origins, in any case not controllable by the safety device of the kind in question, such as breakage of joints or fuel pipes, effects of corrosion, foul play, natural disasters, or poor operation of the electromagnetic valve itself. In any case, the above and other objects, features and advantages of the present invention will become apparent from the following description, given solely by way of non-limiting illustration, when taken in conjunction with the figure of the accompanying drawing.

The single FIGURE is a circuit diagram of the device of the invention.

This device comprises an electromagnetic valve connected to the fuel, e.g. gaseous, supply circuit of a burner and of which only the energizing coil is shown at EV. The burner which is for example a burner for a camping water-heater has not been shown. There is only shown at E its spark igniting electrode, which forms at the same time a detector of the presence of the flame. This electrode E is connected to an electronic ignition circuit A of a known type, e.g. such as described in French Pat. No. 77 18481 assigned to the same assignee as the present application, and which is adapted to supply to the ignition electrode E a series of high voltage pulses producing ignition sparks when its input $e_1$ receives a positive trigger voltage. Apart from its igniting function, circuit A is adapted to supply from electrode E, at its output $s_1$, a signal having two states, supplying the indication of the presence or of the absence of a flame. It is a matter, in a way known per se, of information translating the value of the resistance presented by the flame between electrode E and ground; low potential information $\overline{f}$ when a flame is present, and high potential information when no flame is detected; this information changes state when the resistance detected is of the order of 10 MΩ.

The energizing coil EV for the electromagnetic valve is connected to an electric power supply circuit formed here by a 12 V battery, through an overvoltage circuit S which will be described further on, a conductor 1, a transistor $Q_1$ forming what was called above the controlled switch member, a thermostatic switch T subjected to the temperature to be regulated, and a manually controlled ON/OFF switch I, these two latter switches being contained in a control box C. This box also contains an indicator light for signalling the fault detection state formed by a light-emitting diode $D_1$ connected between the 12 V supply and a line 2 supplying the different elements and components forming the device.

What was called above the multi-input circuit with bistable function is formed essentially by two gates, namely a NOR gate 3 and a NAND gate 4. The output of gate 3 is connected to an input of gate 4 and to the input $e_4$ of an oscillator circuit O adapted to energize another light-emitting diode $D_2$ through a transistor $Q_2$. The output of gate 4 is connected to the base of transistor $Q_1$ through a resistor $R_1$.

Gates 3 and 4 are controlled in a way which will be described hereafter and, among others, by signals coming from outputs $s_2$ and $s_3$ of a logic circuit L one input $e_3$ of which is connected to the outputs $s_1$ of circuit A and the other input $e_2$ to the common point of a circuit $R_2C_2$ having a time constant $t_2$, resistor $R_2$ being connected between the output of gate 3 and the anode of a diode $D_3$ whose cathode is connected to conductor 1.

The other input of gate 4 is similarly connected to the common point of a circuit $R_3C_3$ whose resistor $R_3$ is connected to the output $s_3$ of circuit L and the capacitor $C_3$ to line 2 or to ground.

One input of gate 3 is connected to the common point of a circuit $R_5C_5$ whose capacitor is connected to conductor 1 and its other input is connected to the common point of a circuit $R_6C_6$ whose resistor is connected to the output of gate 4 and the capacitor to the common point between a resistor $R_7$ connected to line 2 and a manual resetting member M (called above resetting means), connected between resistor $R_7$ and conductor 1.

As for the output $s_2$ of logic circuit L, it is connected on the one hand to a circuit $R_4C_4$ whose common point is connected to the other terminal of said resistor $R_5$ and, on the other hand, to the input of an inverter circuit 5 whose output is connected to a control input $e_5$ of the overvoltage circuit S through a resistor $R_8$.

Finally, a capacitor $C_7$ whose role will be described further on, is connected between conductor 1 and ground.

It should be noted furthermore that gates 3 and 4 of the circuit with bistable function are permanently supplied through connections l connected to supply line 2, and that it is preferably arranged for this circuit to come into a fault detecting state should a momentary interruption of the power supply occur (in the figure, gates 3 and 4 are shown with logic levels corresponding to the normal operating state of the device, without setting in the fault detection state.

Before examining the general operation of the device which has just been described, that of the so-called overvoltage circuit S should be examined.

In accordance with another feature of the invention, in fact, in order to economize the current of the supply source and to increase the safety, the hysteresis property of the magnetic circuit of electromagnetic valve EV is used.

For this, an overvoltage circuit S is used for triggering the opening of the electromagnetic valve, able to supply a triggering voltage pulse which is superimposed on the voltage maintaining the opening after triggering. This maintenance voltage is advantageously supplied, for a normal operating condition, by conductor 1 supplied with 12 V. The role of circuit S is then to supply to coil EV, when the opening of the electromagnetic valve is controlled, a pulse voltage distinctly greater than 12 V, a negative pulse triggering signal from inverter 5 being applied to its control input $e_5$. For this purpose, one or more stages are used such as the two stages shown in frame S. Since these stages may be essentially identical to each other, it will be sufficient to describe the first of them, which comprises a transistor $Q_o$ whose emitter is connected to conductor 1 and collector to ground through a charging resistor $R_o$. A capacitor $C_o$ is connected between the collector and the cathode of a diode $D_o$ whose anode is connected to the emitter of the transistor A bias resistor $R_o$ connects further the base of the transistor to conductor 1.

In the absence of a pulse at input $e_5$, transistor $Q_o$ is non conducting and capacitor $C_o$ is charged at 12 V through diode $D_o$ and resistor $R_o$. When transistor $Q_o$ is enabled by a negative pulse at $e_5$, its collector is brought up to the potential of 12 V, and a double voltage is obtained at the positive terminal of capacitor $C_o$. It can be seen that at the output of the following stage a pulse voltage of 36 V may be obtained largely sufficient for controlling the opening of the electromagnetic valve whose maintenance in the open condition is then ensured only by the 12 V DC voltage of the supply. Of course, care has been taken to choose an electromagnetic valve which, though it may be maintained open with a maintenance voltage of only 12 V, can only be triggered by a distinctly greater voltage, which avoids untimely opening of the electromagnetic valve should there occur a short circuit of the coil across the 12 V.

It can furthermore be seen that this arrangement presents the great advantage of considerably reducing the consumption of power required for maintaining the electromagnetic valve in the open position.

Finally, it will be noted in relation to this circuit S that the positive voltage for triggering the spark ignition circuit A (input $e_1$) may be taken from the collector of transistor $Q_o$.

Such being the case, the operation of the device which has just been described is the following:

When a demand for heat occurs, through the closing of contacts I and T, charging of capacitor $C_2$ of the time constant circuit $R_2C_2$ is enabled through diode $D_3$, which supplies at input $e_2$ an element of information $t_2$ active after a certain period of seif control. Logic circuit L combines the elements of information $t_2$ and $\overline{f}$ as indicated at the outputs $s_2$ and $s_3$ to deliver signals capable of switching gates 3 and 4 to the state complementary to the one shown. This switching may be carried out under the effect of the signal appearing at output $s_3$ if, outside the time allocated by the time constant $R_2C_2$, a flame signal f is recorded; the effect of the signal delivered at $s_3$ by circuit L will however be delayed by the time constant of circuit $R_3C_3$, setting in the safety state only taking place if the above-mentioned condition persists a certain length of time (a few seconds). This switching may also be brought about under the effect of the signal appearing at the output $s_2$ if, after appearance of signal $s_2$ an absence of flame is recorded for a length of time greater than that provided by the time constant $R_4C_4$.

Simultaneously, signal $\overline{ft}_2$ from the output $s_2$ controls, through the inverter 5, the opening of electromagnetic valve EV by means of the above-described circuit S, as well as the triggering of circuit A by means of the signal supplied at $e_1$.

The signal $\overline{ft}_2$, which has passed to the active high potential state, and has therefore controlled the ignition phase, after the time delay provided by $R_2C_2$, then returns to the low potential state and so interrupts the operation of ignition circuit A, as soon as the flame appears, because of the low potential signal $\overline{f}$ appearing at that time at $s_1$ and at $e_3$. It should be noted that the delay provided by $R_2C_2$ allows the capacitor $C_o$ of circuit S to be charged, which enables the opening of electromagnetic valve EV to be triggered off and its maintenance in this state after the negative control pulse has disappeared, as explained above.

Oscillator O which is inactive in the normal operating state, operates, in the safety state, to modulate the consumption of the device by means of short and spaced pulses. Signalling diode $D_1$ through which the supply of the logic functions of the device is effected, then flashes under the effect of the modulation which is applied thereto; the average consumption of the device remains however very low (a few mA) taking into account the very low cyclical ratio of the signalling oscillator O. The role of diode 2 mentioned above is to repeat, on the device itself, the visual information of diode $D_1$ which forms part of control box C.

Switching transistor $Q_1$ operates, as we have seen, to interrupt the power supply to electromagnetic valve EV and so the fuel supply to the burner, as soon as gates 3 and 4 forming the above-mentioned circuit with bistable functions, switch to the so-called safety state. It is then important to check that this transistor is in a condition to fulfil this role. This is done through means called above "means for detecting a short circuit of the semiconductor switching member", and which use circuit $R_5C_5$ and capacitor $C_7$. These means operate as follows, on application of voltage to conductor 1, the buffer capacitor $C_7$ is charged through transistor $Q_1$. This latter has its collector current limited, taking into account the constant base current which is supplied thereto, and its current gain. The result is that the charging of capacitor $C_7$ is not instantaneous and follows a gradient of a practically constant slope.

If transistor $Q_1$ is short-circuited, the charging of capacitor $C_7$ is much more rapid. The circuit $R_5C_5$ allows the distinction between these two behaviours to be effected: in the second case, it applies to the corresponding input of gate 3 a pulse positioning the circuit with bistable function in the so-called fault detection state.

At the time of a subsequent igniting attempt, the charging of capacitor $C_2$ cannot consequently take place on the ignition cycle will be disabled.

Concerning the manual resetting member M, it should be noted that it allows in principle the circuit with bistable function 3,4 to be reset in the normal operating state, but it is arranged for this resetting not to be effected if transistor $Q_1$ is short-circuited.

It was pointed out above that capacitor $C_3$ could be connected to line 2 or to ground. It should be noted that by connecting this capacitor $C_3$ to ground, as shown in the figure, it is provided that should the general supply be interrupted, the circuit with bistable function 3,4 is placed in the safety state when voltage is then applied thereto, which prevents untimely resetting of the device if an interruption of the supply follows setting in the safety state.

As can be seen, the device which has just been described presents numerous advantages, among which can be cited:

a very low permanent consumption (a few microamps), the logic functions shown being able to use C-MOS technology integrated circuits whose consumption is extremely small;

a very low consumption under operating conditions (a few tens of mA) or in a safety state (a few mA), which allow, without the need to design an electromagnetic valve other than those available on the market, a high self sufficiency of operation with low capacity sources (dry cells or accumulators) and an appreciable economy of means, the electromagnetic relay(s) traditionally used being omitted.

It will be noted in this connection that, taking into account the imperfections and the mediocre reliability of these components, the risk of meeting dangerous situations will be reduced with the device in accordance with the invention. This risk is essentially that of poor operation of the circuit with bistable function, namely that of a failure of gates 3 and 4, of capacitor $C_5$ and of some soldered connections. It compares advantageously with the risk of failure of an electro-mechanical component, without even considering that said component must itself be controlled by a transistor or equivalent means also subjected to the risk of breakdown.

Of course, it is apparent that within the scope of the invention, modifications and different arrangements can be made other than are here disclosed. It would be easy in fact to add to or modify the logic functions so as to introduce for example additional safety setting conditions, such as overheating, insufficiency of the supply voltage, preliminary tests of the proper operation of the igniter, detection of an insulation defect of electrode E etc. Similarly, other supply modes, particularly by means of an AC current distribution network may be provided.

As it follows and as is evident from what has gone before, the invention is in no wise limited to those of its modes of application and embodiments which have been more specially considered; it embraces, on the contrary, all variations thereof.

I claim:

1. An electronic safety device for fluid, particularly gaseous, fuel burner, of the intermittent operating type, said device being of the type adapted to operate in successive heat demand cycles for alternately producing a flame and for providing for extinction of the flame depending respectively on the presence or absence of a heat demand, the fuel supply to the burner being controlled by an electromagnetic valve connected to an electrical power supply circuit comprising at least two controlled switches, a first one of said switches comprising a thermostatic switch subjected to the temperature to be regulated, and a further one of said switches comprising a manually controlled on/off switch, the connection to the electrical power supply being made by means of a controlled switch member, said device having several operating states at least one of which comprises a safety state in which the input of the fuel to the burner is inhibited, said safety state being removed only by manual actuation of a resetting means, wherein the improvement comprises the provision of a said controlled switch member comprising a semi-conductor switch member and of a multi-input logic circuit means, which provides bistable operation and includes an output terminal connected to the control electrode of said switch member, for producing, responsive to the manual actuation of said resetting means, a first, "normal operating" output in which the said switch member is maintained in a conductive condition and the fuel valve is open and for producing, responsive to at least one fault requiring interruption of the fuel supply at least by the time at which the subsequent heat demand cycle is initiated, a second, "fault detection" output in which said switch member is rendered non-conductive and said fuel valve is closed; and the provision of short circuit detection means, connected to one input of said multi-input logic means, for detecting short-circuiting of said controlled switch member and for causing said logic means to produce said "fault detection" output responsive to short circuiting of said controlled switch member.

2. A device as claimed in claim 1 wherein one input of said multi-input logic means is connected to a continuous power supply, said logic means including means for causing said multi-input logic means to produce said "fault detection" output responsive to interruption of the connection to said power supply.

3. A device as claimed in claims 1 or 2 further comprising an electromagnetic valve exhibiting hysteresis properties, said device further including circuit means for triggering the opening of said electromagnetic valve and for supplying a trigger voltage pulse which is superimposed on a fixed supply voltage for maintaining the valve in an open condition after triggering thereof.

4. A device as claimed in claim 3 wherein the triggering voltage of said electromagnetic valve is greater than said fixed supply voltage and the maintenance voltage of said electromagnetic valve is less than said fixed supply voltage.

5. A device as claimed in claim 1 or 2 further comprising signaling means for remote signaling of a fault detection condition.

6. A device as claimed in claim 5 wherein said remote signaling means is adapted to cause an increase in the electrical consumption as modulated with a low cyclical ratio.

* * * * *

UNITED STATES PATENT AND TRADEMARK OFFICE

CERTIFICATE OF CORRECTION

PATENT NO. : 4,324,542

DATED : April 13, 1982

INVENTOR(S) : Challet, Jacques

It is certified that error appears in the above—identified patent and that said Letters Patent is hereby corrected as shown below:

On the title page, assignee should read:

-- (73) Assignee: Constructions Electriques R.V. --

Signed and Sealed this

*Fourteenth* Day of *September 1982*

[SEAL]

*Attest:*

GERALD J. MOSSINGHOFF

*Attesting Officer*

*Commissioner of Patents and Trademarks*